US008633411B2

(12) United States Patent
Chen

(10) Patent No.: US 8,633,411 B2
(45) Date of Patent: Jan. 21, 2014

(54) SIDE BUTTON STRUCTURE FOR ELECTRONIC DEVICE

(75) Inventor: Rui-Hao Chen, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 177 days.

(21) Appl. No.: 13/283,257

(22) Filed: Oct. 27, 2011

(65) Prior Publication Data

US 2012/0125753 A1 May 24, 2012

(30) Foreign Application Priority Data

Nov. 22, 2010 (CN) ..... 2010 1 0557077

(51) Int. Cl.
*H01H 13/70* (2006.01)

(52) U.S. Cl.
USPC ..... 200/341; 200/5 A; 200/344; 200/345

(58) Field of Classification Search
USPC ..... 200/341, 344, 345
See application file for complete search history.

(56) References Cited

U.S. PATENT DOCUMENTS

| | | | | |
|---|---|---|---|---|
| 5,941,373 | A * | 8/1999 | Cheng | 200/344 |
| 6,615,453 | B2 * | 9/2003 | Lin | 16/441 |
| 7,232,970 | B1 * | 6/2007 | Chen | 200/332.2 |
| 2009/0236207 | A1 * | 9/2009 | Shi et al. | 200/341 |

* cited by examiner

*Primary Examiner* — Renee Luebke
*Assistant Examiner* — Ahmed Saeed
(74) *Attorney, Agent, or Firm* — Altis Law Group, Inc.

(57) ABSTRACT

A side button structure includes a housing with switches, and a button assembly moveably fixed on the housing; the button assembly includes a flexible pin and at least one pressing blocks, the flexible pin passing through the pressing blocks. Pressing the button assembly enables the flexible pin to deform, the button assembly to move to the housing, and the pressing blocks to attach to the switches.

16 Claims, 4 Drawing Sheets

SIDE BUTTON STRUCTURE FOR ELECTRONIC DEVICE

BACKGROUND

1. Technical Field

The present disclosure generally relates to a side button structure for an electronic device.

2. Description of Related Art

Portable electronic devices such as mobile phones, laptops, and personal digital assistants (PDAs) often include input devices such as keyboards, touch panels, and function buttons.

Button assembly usually includes a button and an elastic sheet mounted to the button. However, the elastic sheet may be hooked to the button by a hook, making the entire structure overly complex.

Therefore, there is room for improvement within the art.

BRIEF DESCRIPTION OF THE FIGURE

Many aspects of the side button structure can be better understood with reference to the following drawings. The components in the drawings are not necessarily drawn to scale, the emphasis instead being placed upon clearly illustrating the principles of the side button structure. Moreover, in the drawings like reference numerals designate corresponding parts throughout the several views. Wherever possible, the same reference numbers are used throughout the drawings to refer to the same or like elements of an embodiment.

DETAILED DESCRIPTION

Figure 1:
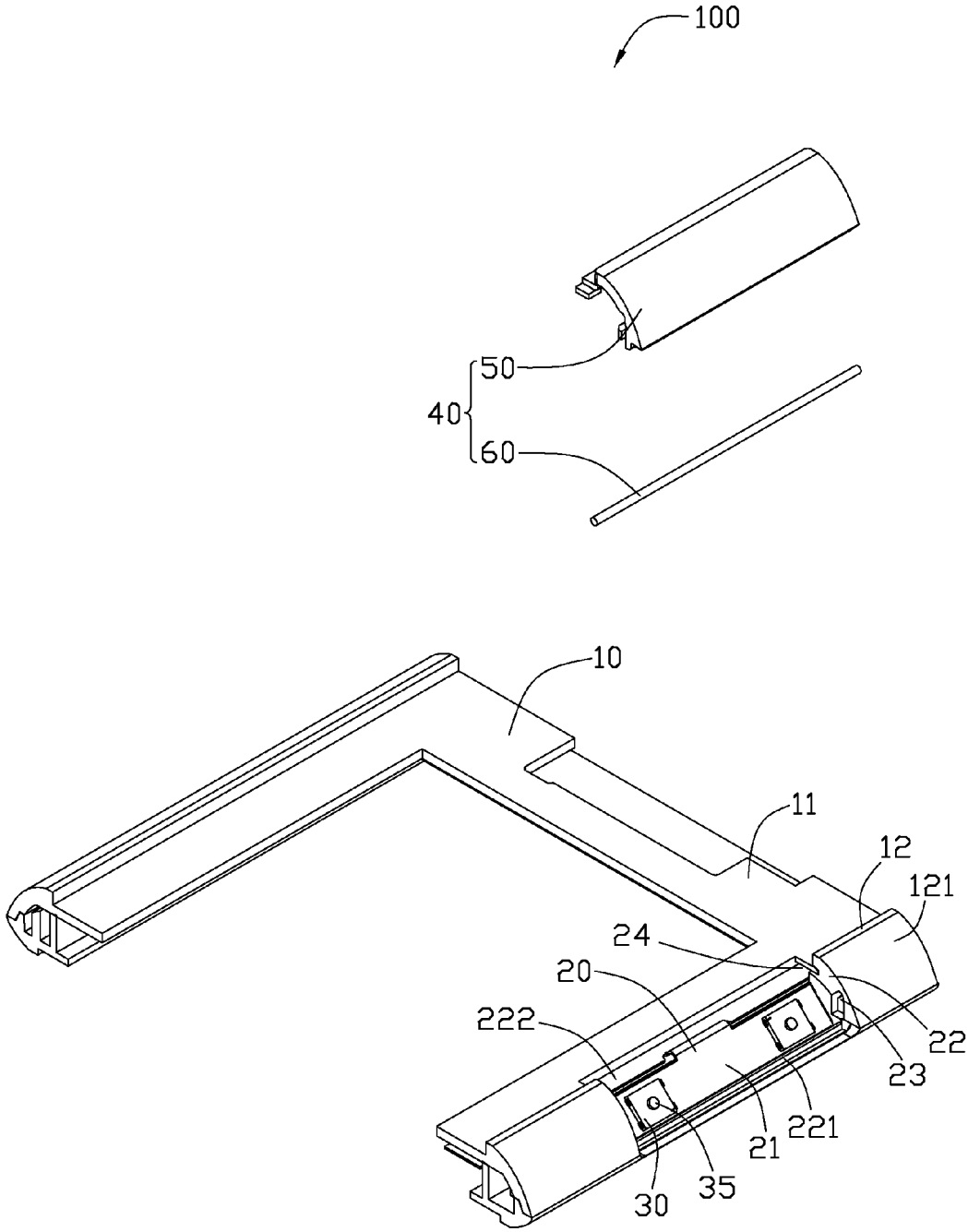
FIG. 1 is an exploded view of an exemplary side button structure.

FIG. 1 shows a side button structure 100 according to an exemplary embodiment. The side button structure 100 may be used in a mobile phone, a personal data assistant, or other portable electronic devices. The side button structure 100 includes a housing 10 and a button assembly 40 moveably mounted on the housing 10.

Figure 2:
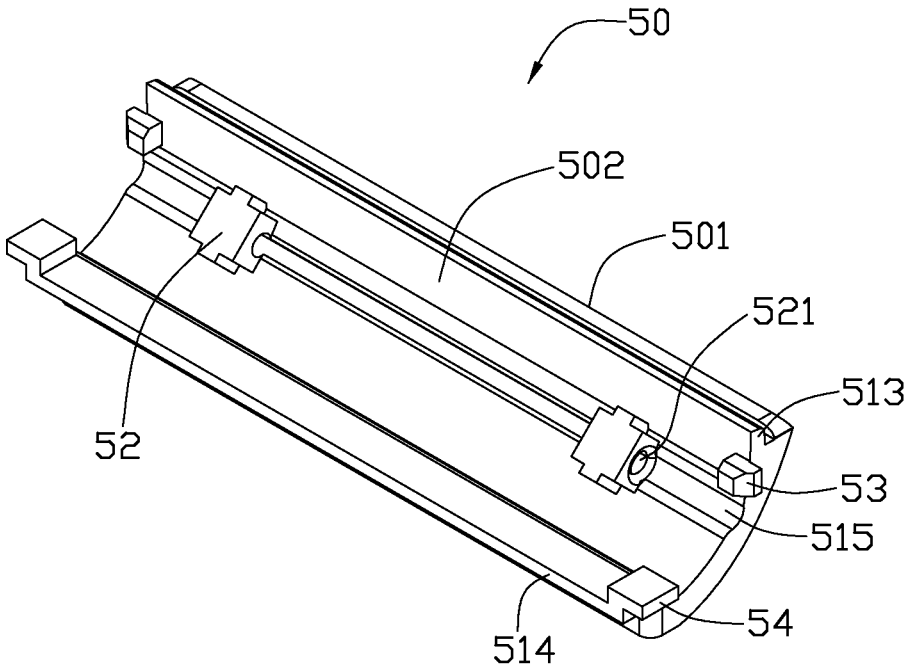
FIG. 2 is an enlarged view of the button cap of the side button structure, but viewed from another angle.

The button assembly 40 includes a button cap 50 and a pin 60 mounted in the button cap 50 (best shown in FIG. 2). The button cap 50 is substantially arched shaped, including an arcuate pressing surface 501 and an installing surface 502 opposite to the pressing surface 501.

Referring to FIG. 2, the button cap 50 includes an installing plate 514, a block 513, two pressing block 52, two first protrusions 53, and two second protrusions 54 on the installing surface 502. The installing plate 514 longitudinally positions at one side of the installing surface 502. The block 513 extends from an opposite side of the installing surface 502. The installing surface 502 defines a groove 515 longitudinally locating between the installing plate 514 and the block 513. The two pressing blocks 52 are spaced from each other and placed above the groove 515. Each pressing block 52 defines a round through hole 521 horizontally communicating with the groove 515. The pin 60 is mounted on the button cap 50 and is further received in the groove 515 and the two through holes 521. The pin 60 can exceed out of the groove 515. The pin 60 may be made of stainless steel and is provided with flexibility. The two first protrusions 53 extend from opposite ends of the installing surface 502 and are adjacent to the groove 515. The two second protrusions 54 extend from opposite ends of the installing plate 514. The two first protrusions 53 and the two second protrusions 54 are made of flexible and elastic materials such as rubber.

The housing 10 includes a panel 11, and two opposing sidewalls 12. The two sidewalls 12 connect to opposite sides of the panel 11. Each sidewall 12 defines a receiving space 20 configured to receive the button assembly 40. Each side wall 12 has an arcuate exterior surface 121. The pressing surface 501 mates with the exterior surface 121 when the button assembly 40 is received in the receiving space 20. The receiving space 20 is enclosed by a bottom wall 21 and two end walls 22 extending in a substantially perpendicular manner from opposite ends of the bottom wall 21.

Two circuit boards 30 are fixed on the bottom wall 21 and each circuit board 30 has a switch 35 positioned thereon. The two switches 35 are configured for electrically connecting to the circuit board 30. The bottom wall 21 longitudinally defines a receiving groove 221 for receiving the block 513. A supporting portion 222 is formed on the bottom wall 21. Each end wall 22 defines a mounting hole 23 for receiving the pin 60 and the first protrusion 53. Each end wall 22 defines a notch 24 locating at the conjunction of each end wall 22 and the supporting portion 222. The two notches 24 are configured for receiving the two second protrusions 54.

Figure 3:
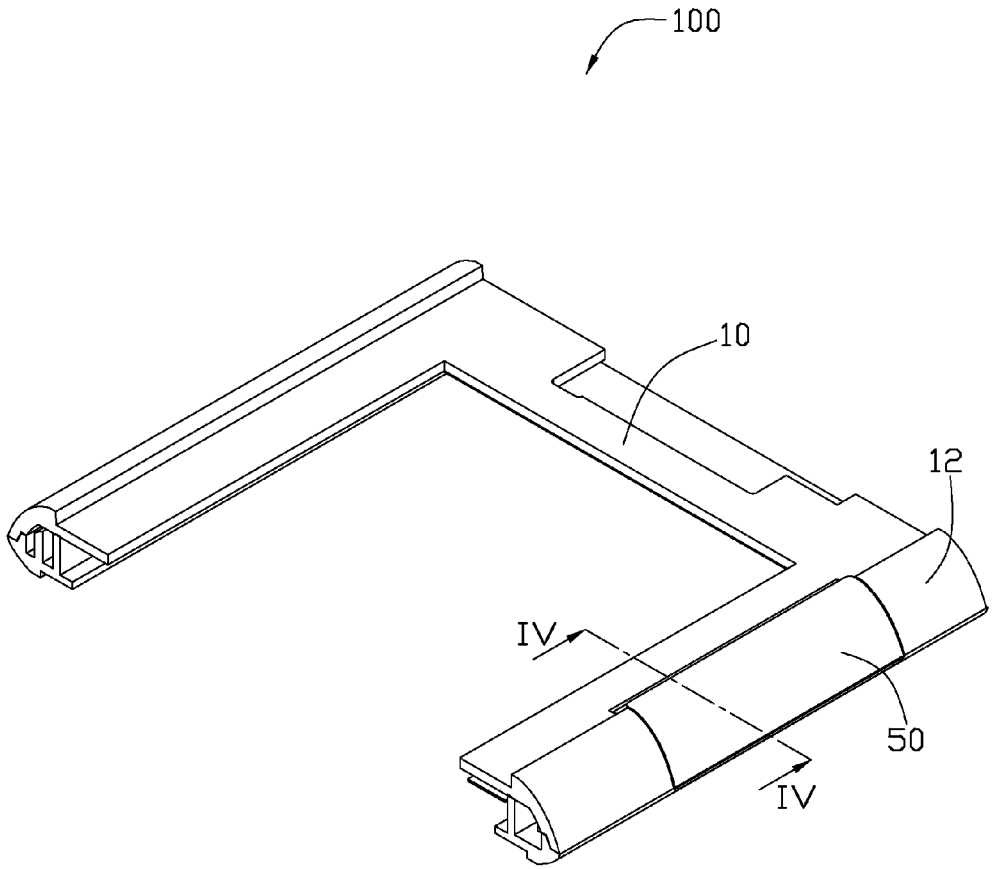
FIG. 3 is an assembled view of the side button structure of FIG. 1.
Figure 4:
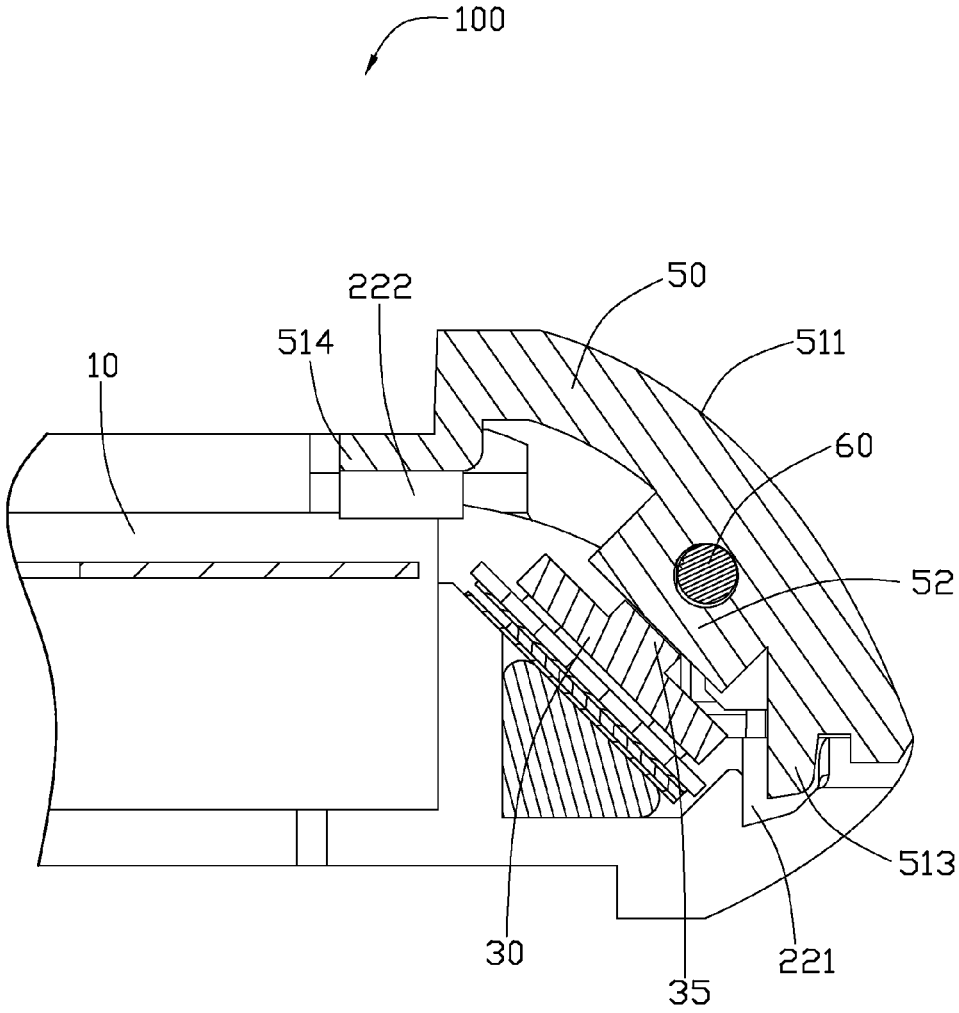
FIG. 4 is a sectional view of the side button structure of FIG. 3 along line IV-IV.

Referring to FIG. 3 and FIG. 4, in assembly, the pin 60 is mounted into the button cap 50. Then the assembled button assembly 40 is pressed towards the receiving space 20, until two ends of the pin 60 and the two first protrusions 53 are received into the two mounting holes 23. So the button assembly 40 is mounted into the receiving space 20. The installing plate 514 faces the supporting portion 222, and the block 513 is moveably received in the receiving groove 221. The second protrusions 54 are received in the notch 24, and each of the two pressing blocks 52 faces the corresponding one of the two switches 35.

In use, when the button cap 50 is pressed, the pin 60 deforms towards the housing 10, enabling the button cap 50 to move towards the housing 10. In this process, the block 513 moves into the receiving groove 221, and the installing plate 514 abuts against the supporting portion 222. The two pressing blocks 52 contact and resist against the two switches 35, urging the two switches 35 to electrically connect to the circuit board 30. When the button cap 50 is released, the pin 60 restores and urges the button cap 50 back to the original position.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A side button structure for an electronic device, comprising:

a housing comprising at least one switch; and a button assembly moveably mounted on the housing, the button assembly comprising:

at least one pressing block facing the at least one switch; and a flexible pin passing through the at least one pressing block, the flexible pin having two opposite ends thereof fixed to the housing and being capable of deforming when the button assembly is pressed, enabling each of the at least one pressing block to move towards and press against the each corresponding one of at least one switch;

wherein the housing defines a receiving space for receiving the button assembly, the button assembly comprises a button cap having an installing surface and a pressing surface opposite to the installing surface, a groove is defined in the installing surface, the at least one pressing blocks are positioned above the groove, a through hole communicating with the groove is defined in each pressing block, the flexible pin passes through the through holes and receives in the groove.

2. The side button structure as claimed in claim 1, wherein the flexible pin is made of stainless steel.

3. The side button structure as claimed in claim 1, wherein the flexible pin exceeds out of the groove.

4. The side button structure as claimed in claim 1, wherein the receiving space defines two mounting holes, the two opposite ends of the flexible pin receives in the two mounting holes.

5. The side button structure as claimed in claim 1, wherein the button cap comprises two first protrusions extending from the installing surface and being moveably received in the two mounting holes.

6. The side button structure as claimed in claim 1, wherein the receiving space defines two notches, the button cap comprises two second protrusions extending from the installing surface and being received in the two notches.

7. The side button structure as claimed in claim 1, wherein the receiving space defines a receiving groove, the button cap comprises a block extending from the installing surface and being moveably received in the receiving groove.

8. The side button structure as claimed in claim 1, wherein a supporting portion positions in the receiving space, an installing plate positions on the installing plate and faces the supporting portion.

9. A side button structure, comprising:

a housing comprising a switch;

a button assembly attached to the housing, the button assembly comprising:

a pressing block configured for moving to press against the switch; and a pin secured in the pressing block and having two opposite ends thereof secured to the housing, the pin being flexible and deforming under external pressing force to enable the movement of the pressing block relative to the switch;

wherein the housing defines a receiving space for receiving the button assembly, the button assembly comprises a button cap having an installing surface and a pressing surface opposite to the installing surface, a groove is defined in the installing surface, the pressing block are positioned above the groove, a through hole communicating with the groove is defined in the pressing block, the pin passes through the through hole and receives in the groove.

10. The side button structure as claimed in claim 9, wherein the pin exceeds out of the groove.

11. The side button structure as claimed in claim 9, wherein the receiving space defines two mounting holes, the two opposite ends of the pin receives in the two mounting holes.

12. The side button structure as claimed in claim 9, wherein the button cap comprises two first protrusions extending from the installing surface and being moveably received in the two mounting holes.

13. The side button structure as claimed in claim 9, wherein the receiving space defines two notches, the button cap comprises two second protrusions extending from the installing surface and being received in the two notches.

14. The side button structure as claimed in claim 9, wherein the receiving space defines a receiving groove, the button cap comprises a block extending from the installing surface and being moveably received in the receiving groove.

15. The side button structure as claimed in claim 9, wherein a supporting portion positions in the receiving space, an installing plate positions on the installing plate and faces the supporting portion.

16. The side button structure as claimed in claim 9, wherein the pin is made of stainless steel.

* * * * *